US009808926B2

(12) United States Patent
Ott

(10) Patent No.: US 9,808,926 B2
(45) Date of Patent: Nov. 7, 2017

(54) ON-BOARD HAND TOOL ACCESSORY

(71) Applicant: Kurt Ott, Schwenksville, PA (US)

(72) Inventor: Kurt Ott, Schwenksville, PA (US)

( * ) Notice: Subject to any disclaimer, the term of this patent is extended or adjusted under 35 U.S.C. 154(b) by 355 days.

(21) Appl. No.: 14/530,078

(22) Filed: Oct. 31, 2014

(65) Prior Publication Data

US 2015/0122090 A1 May 7, 2015

Related U.S. Application Data

(60) Provisional application No. 61/898,896, filed on Nov. 1, 2013.

(51) Int. Cl.

| | |
|---|---|
| ***B25B 13/48*** | (2006.01) |
| ***B25B 13/08*** | (2006.01) |
| ***B25B 23/12*** | (2006.01) |
| ***B25F 1/00*** | (2006.01) |
| ***B25B 15/02*** | (2006.01) |
| ***B25F 1/02*** | (2006.01) |

(52) U.S. Cl.

CPC ..... *B25F 1/00* (2013.01); *B25F 1/02* (2013.01); *B25B 13/08* (2013.01); *B25B 13/48* (2013.01); *B25B 15/02* (2013.01); *B25B 23/12* (2013.01)

(58) Field of Classification Search

CPC ..... B25B 13/08; B25B 13/48; B25B 23/12; B25B 15/02; B25F 1/00; B25F 1/02

USPC ..... 81/58.2, 124.5, 177.7

See application file for complete search history.

(56) References Cited

U.S. PATENT DOCUMENTS

| | | | | | |
|---|---|---|---|---|---|
| 65,550 | A * | 6/1867 | Dunlap | B25B 13/005 | 81/124.5 |
| 586,849 | A * | 7/1897 | Ibelli | B26B 1/04 | 30/153 |
| 3,370,307 | A * | 2/1968 | Beeks | B25F 1/04 | 7/138 |
| 5,259,281 | A * | 11/1993 | Burke | B25B 13/04 | 7/138 |
| 5,600,914 | A * | 2/1997 | Tatar | A01K 97/00 | 30/125 |
| 6,276,014 | B1 * | 8/2001 | Lee | B26B 11/00 | 30/162 |
| 6,901,823 | B2 * | 6/2005 | Ernesti | B25B 13/46 | 7/138 |
| 7,201,086 | B2 * | 4/2007 | Hansen | B25B 13/04 | 81/124.5 |
| 8,505,420 | B2 * | 8/2013 | Alfaro | B25G 1/10 | 206/350 |

(Continued)

*Primary Examiner* — Hadi Shakeri

(74) *Attorney, Agent, or Firm* — Saul Ewing Arnstein & Lehr, LLP

(57) ABSTRACT

A hand tool for servicing a power tool or other host tool is adapted to be readily mountable to and dismountable from the host tool via magnetic coupling. The hand tool includes a handle body, and a nut driver supported on the handle body. The handle body may define a bifurcated support, and the tool may include a pivot pin extending through the bifurcated support and the nut driver to support the nut driver on the tool. The nut driver defines at least one socket region dimensioned to receive a nut, and further is magnetized for magnetic coupling with a nut positioned within the socket region. In one embodiment, the nut driver houses a discrete magnet for this purpose. A second magnet may be supported on the handle body toward its central portion.

16 Claims, 13 Drawing Sheets

(56) References Cited

U.S. PATENT DOCUMENTS

| | | | | |
|---|---|---|---|---|
| 8,863,622 | B1 * | 10/2014 | Kingsberry | B25B 23/12 81/125 |
| 2006/0117915 | A1 * | 6/2006 | Hui | B25B 13/06 81/124.4 |

* cited by examiner

ON-BOARD HAND TOOL ACCESSORY

CROSS-REFERENCE TO RELATED APPLICATIONS

The present application claims the benefit of priority, under 35 U.S.C. 119(e), of U.S. Provisional Patent Application No. 61/898,896, filed Nov. 1, 2013, the entire disclosure of which is hereby incorporated herein by reference.

FIELD OF THE INVENTION

The present invention relates generally to hand tools and more particularly to accessories for manually-operated or power tools, such as gasoline- and electric-powered chainsaws.

BACKGROUND

The accessories of the present invention can be adapted for a variety of hand and power tools, including cutting tools such as motorized chainsaws. Generally, chain saws include a motor for powering the chain saw, a guide bar and a saw chain circulating about the guide bar. Chain saws are exemplary of many power tools for which the present invention is well-suited in that it is assembled using bolts/nuts made of metal that occasionally need to be tightened/loosed and/or include a housing or other components made of metal.

SUMMARY

The present invention provides a hand tool accessory for use in assembly, maintenance, and/or disassembly of the power tool. The hand tool is provided as a power tool accessory that is configured to be readily mountable to and dismountable from the power tool. Preferably, the hand tool accessory is readily mountable/dismountable via magnetic coupling with power tool. Thus, the hand tool accessory is storable on the power tool so that the hand tool tends to remain with the power tool at all times, including during use and operation of the power tool, so that the hand tool is readily available for use to assemble, maintain and/or disassemble the power tool, and tends not misplaced or lost at the point in time at which it is needed.

The hand tool includes a handle body, and a nut driver supported on the handle body. The handle body may define a bifurcated support, and the tool may include a pivot pin extending through the bifurcated support and the nut driver to support the nut driver on the tool. The nut driver defines at least one socket region dimensioned to receive a nut, and further is magnetized for magnetic coupling with a nut positioned within the socket region. In one embodiment, the nut driver houses a discrete magnet for this purpose. A second magnet may be supported on the handle body toward its central portion. The tool may be mounted to a host tool by position the host tool's nut within the socket region, thereby magnetically coupling the hand tool to the host tool. The handle body may be pivoted relative to the nut driver to fold against the tool body, with the second magnet magnetically coupling with the host tool's body to further support the hand tool on the host tool.

BRIEF DESCRIPTION OF THE FIGURES

An understanding of the following description will be facilitated by reference to the attached drawings, in which.

DETAILED DESCRIPTION

FIGS. 1-12 show an exemplary hand tool accessory 10 in accordance with one aspect of the present invention. The exemplary hand tool accessory has a thin ergonomic body and a compact multi-tool design.

Figure 1:
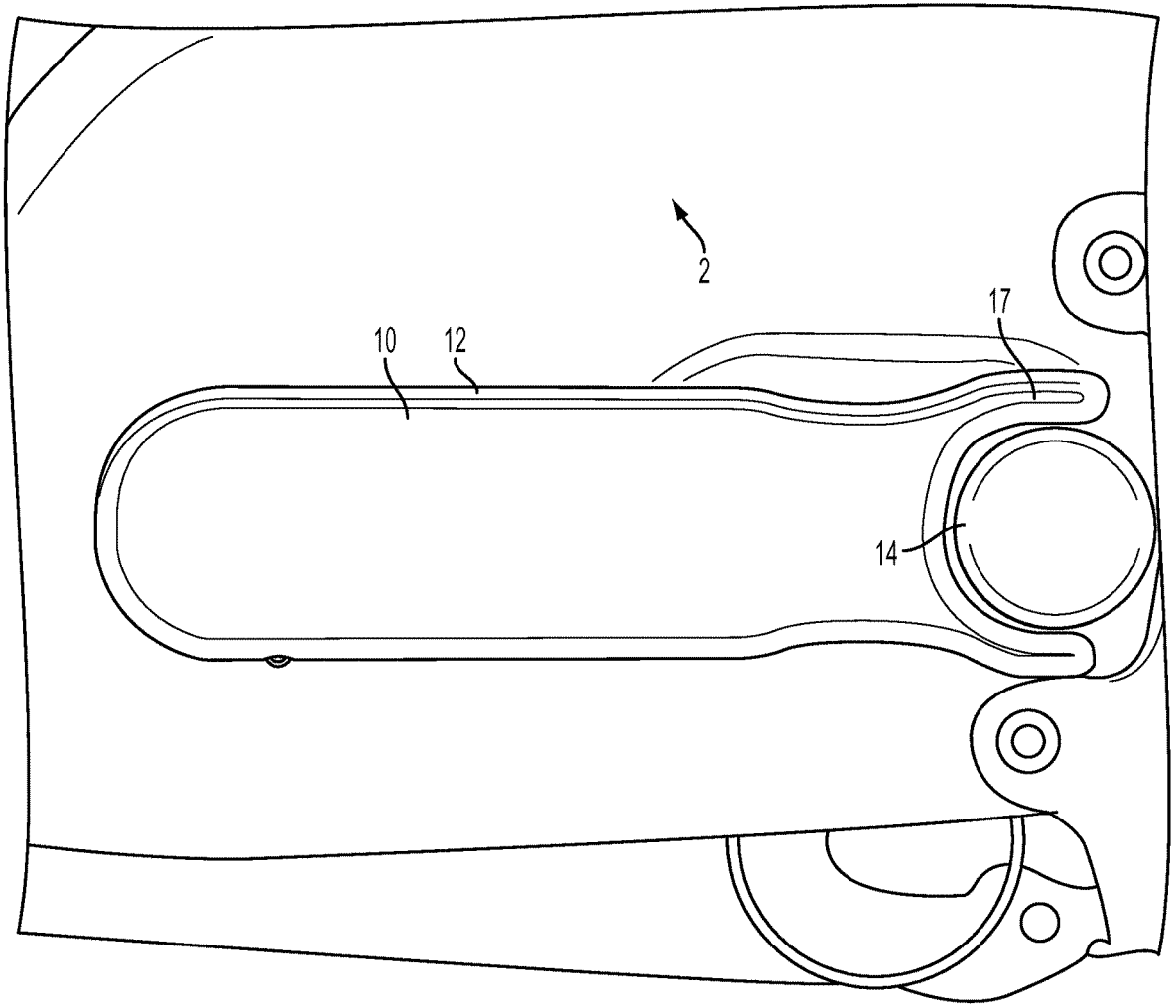
FIG. 1 is a front side view of an exemplary hand tool accessory in accordance with an exemplary embodiment of the present invention, shown in a folded position for storage.
Figure 2:
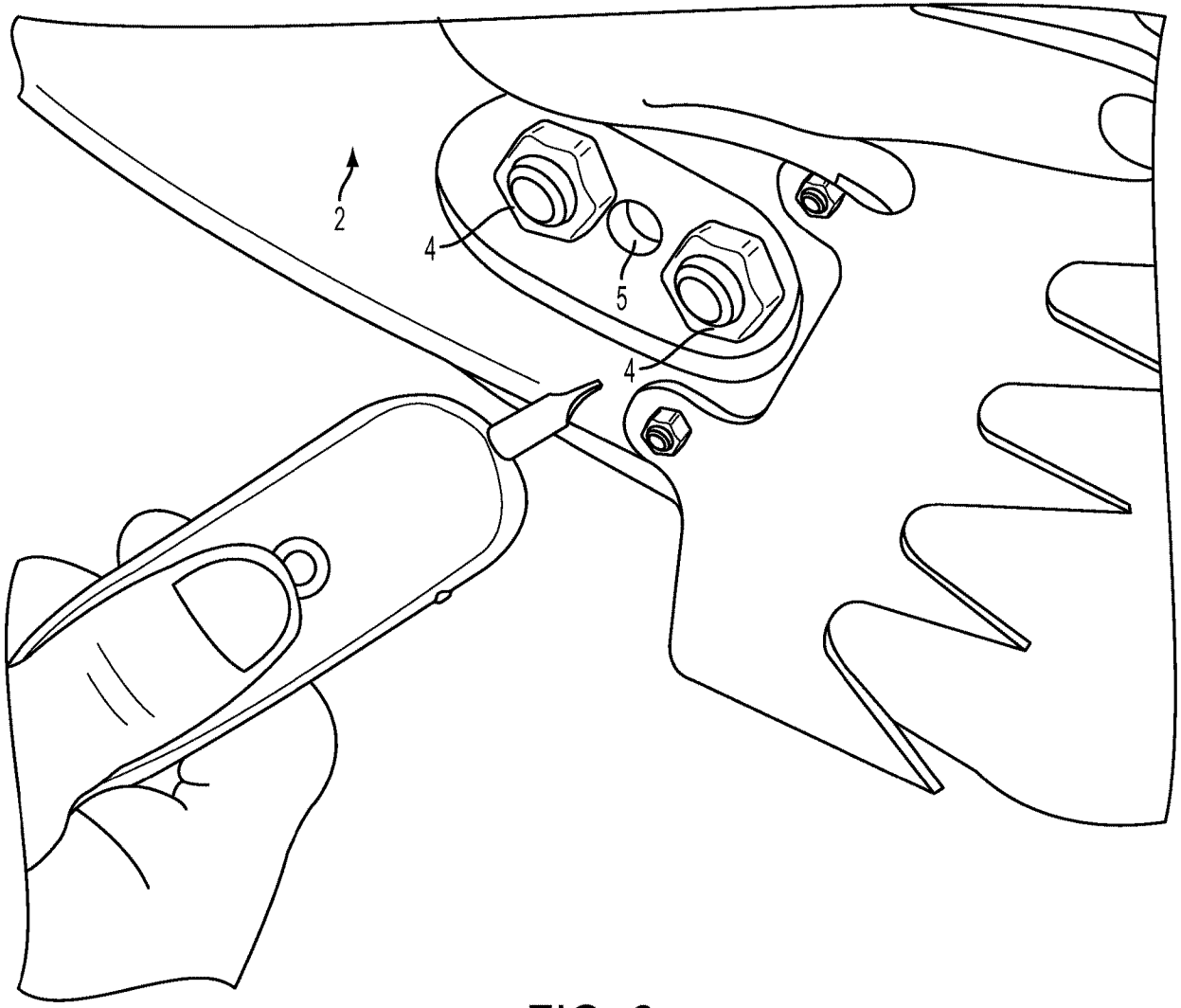
FIG. 2 is a back view of the hand tool of FIG. 1, showing a screwdriver tip extended in an operative position.

Referring now to FIGS. 1 and 2, the hand tool 10 may be used, for example, to loosen and tighten screws and nuts of a power tool, such as those of a chainsaw 2. By way of example, a typical chainsaw includes chain bar nuts 4 and a tensioning screw 5 that tensions the cutting chain when replacing the chain from wear, or to take out the slack on the chainsaws cutting chain so it remains tightly within the guide bars chain slot during use, as best shown in FIG. 2.

The hand tool 10 includes a handle 12 that supports a nut driver 14. In this example, the nut driver 14 has the form of a substantially conventional socket of a type often found in ratchet/socket sets. For chainsaws, for example, 10 mm, 13 mm, and 19 mm sockets will accommodate nearly all nuts of nearly all common, commercially-available chain bar nuts.

Figure 3:
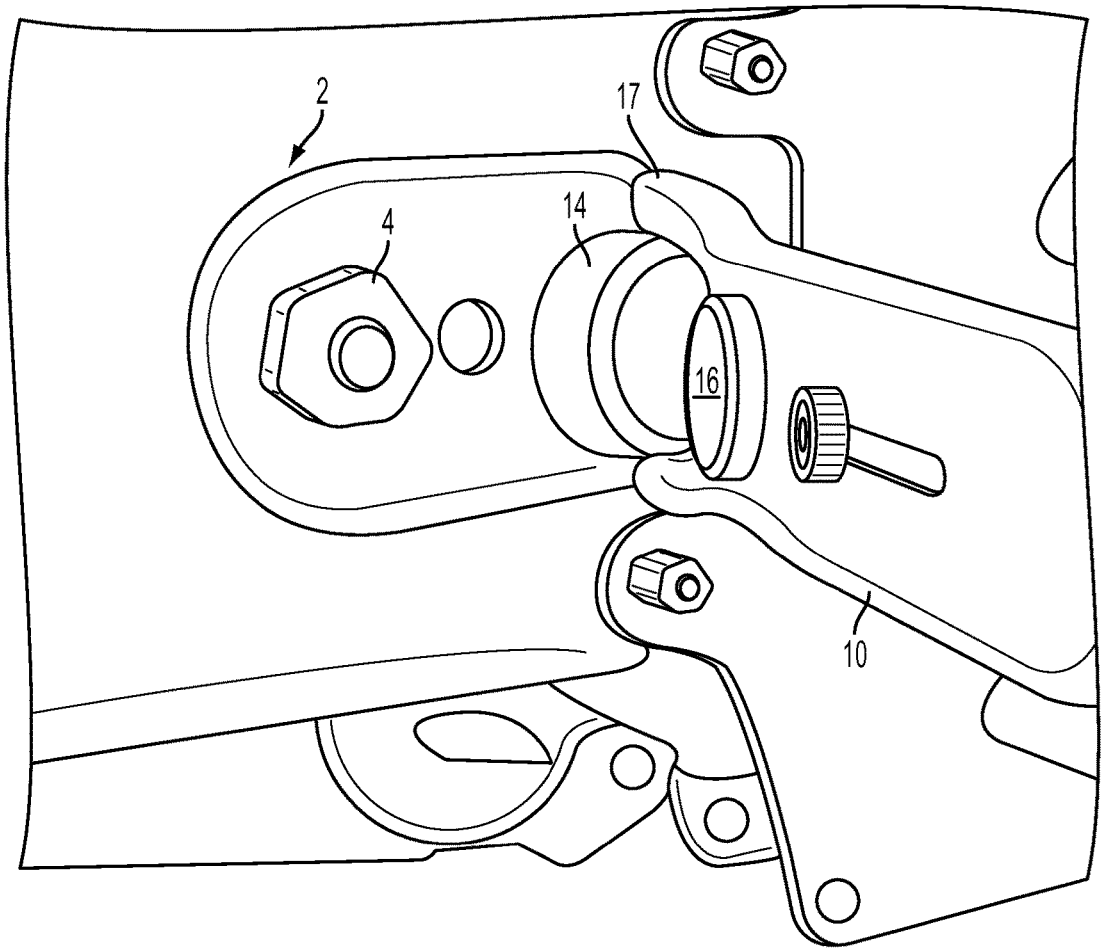
FIG. 3 is a back side view of the hand tool of FIG. 1, showing the handle in an unfolded position in which the handle is axially aligned with the nut driver.
Figure 6:
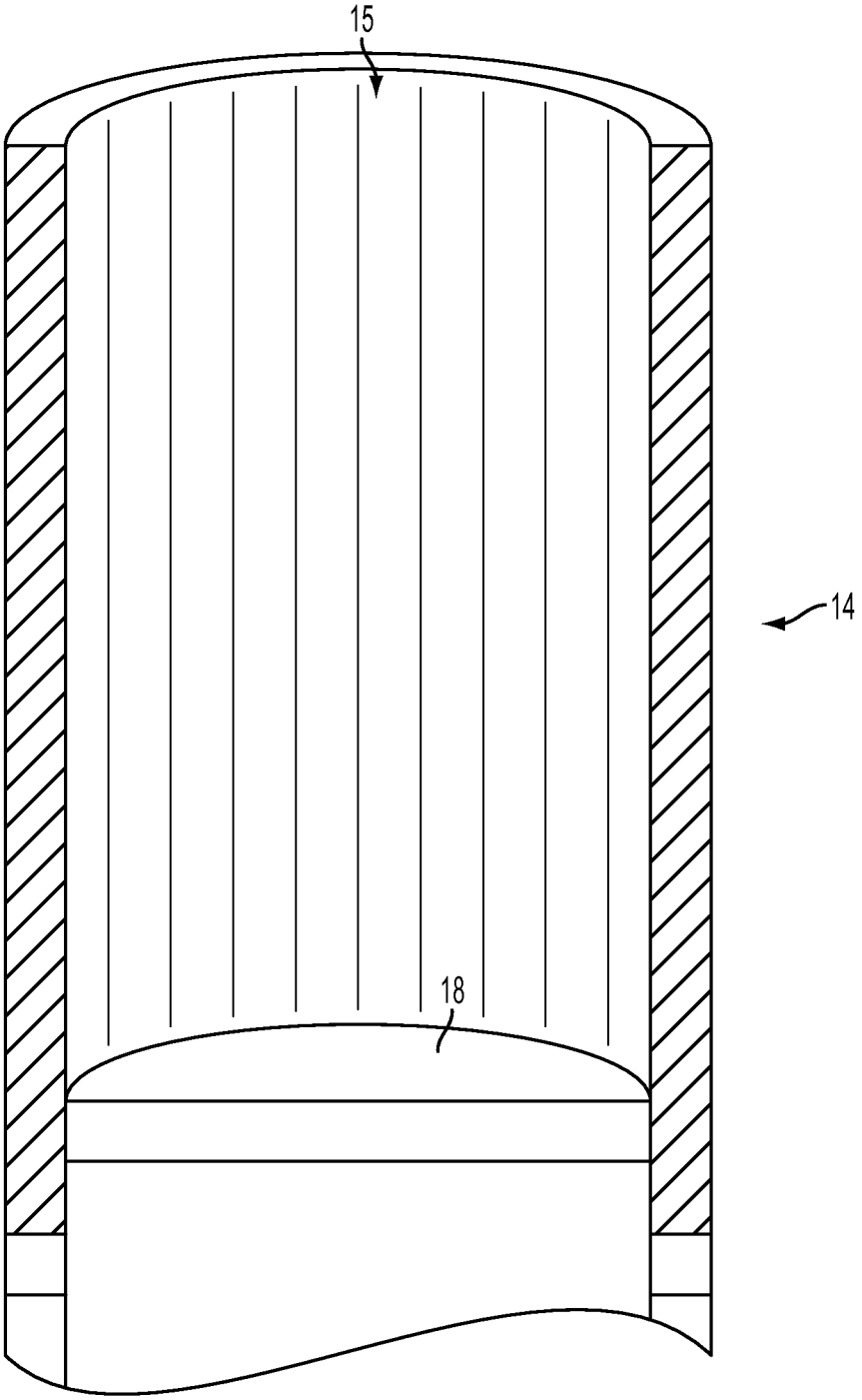
FIG. 6 is a cross-sectional view of a nut driver of the hand tool of FIG. 1.
Figure 7A:
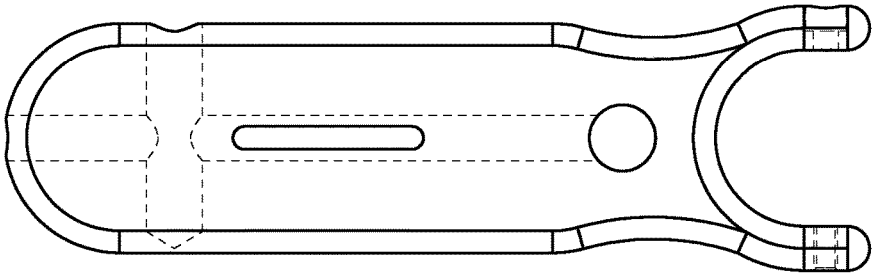
FIGS. 7A-7D are side, end, top, and perspective views, respectively, of the handle of the hand tool of FIG. 1.
Figure 7B:
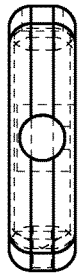
Figure 7C:
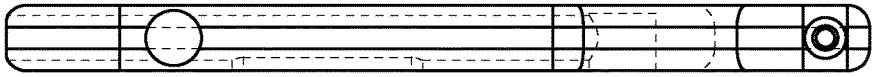
Figure 7D:
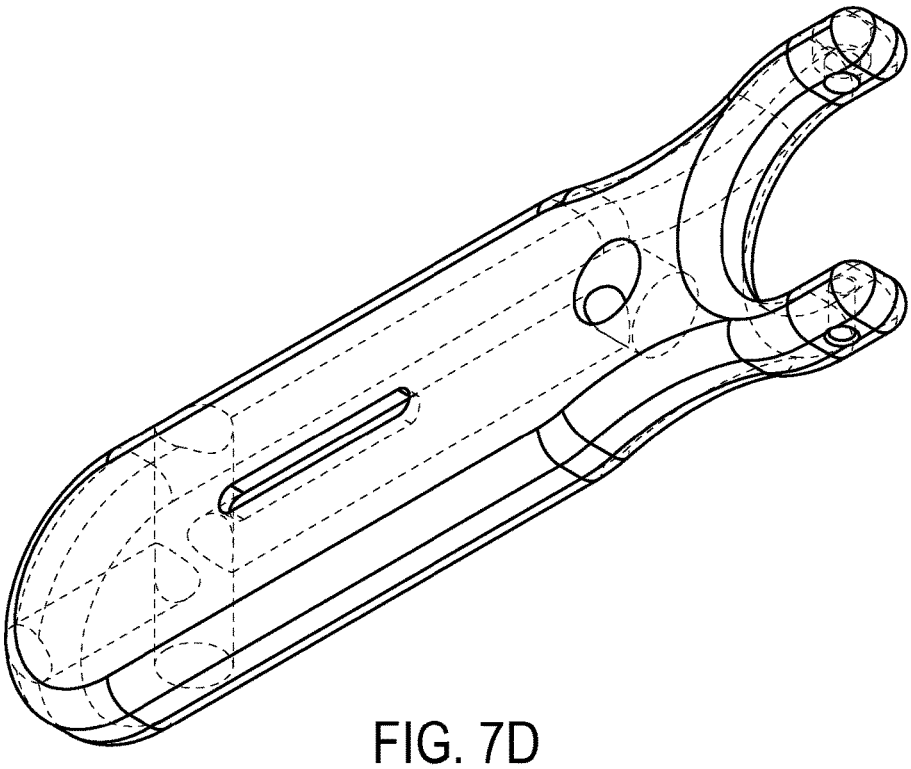
Figure 8A:
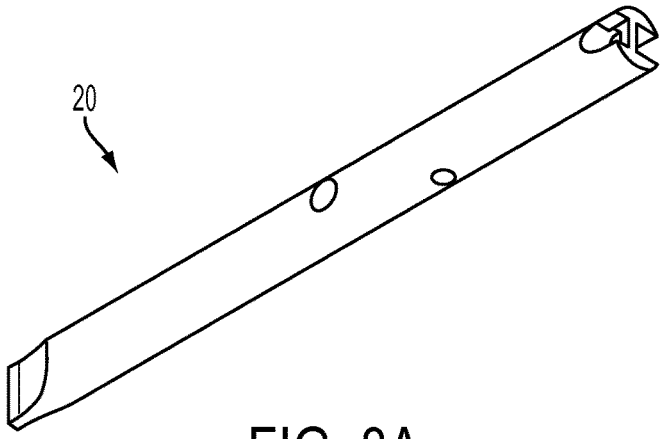
FIGS. 8A-8D show perspective, left side, top and right side views, respectively, of a screwdriver shaft of the hand tool of FIG. 1.
Figure 8B:
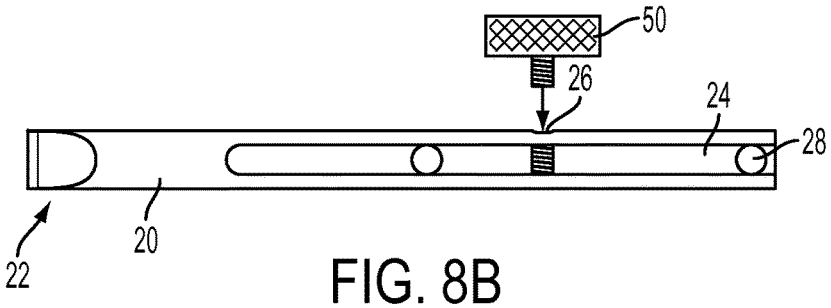
Figure 8C:
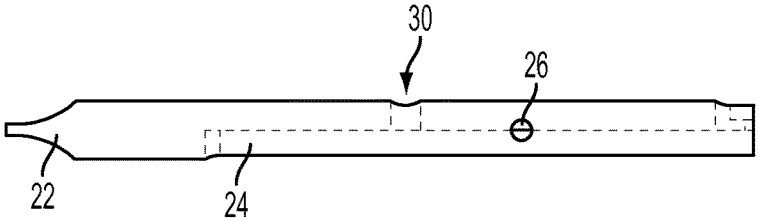
Figure 8D:
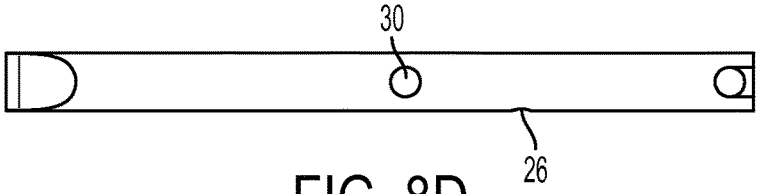
Figure 9A:
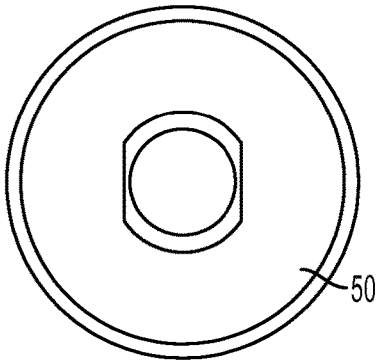
FIGS. 9A-9D show top, side, bottom and perspective views, respectively, of the knurled button of the exemplary hand tool of FIG. 1.
Figure 9B:
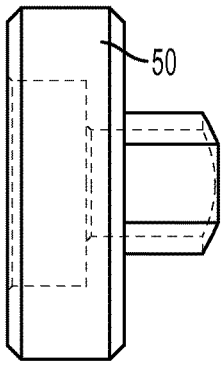
Figure 9C:
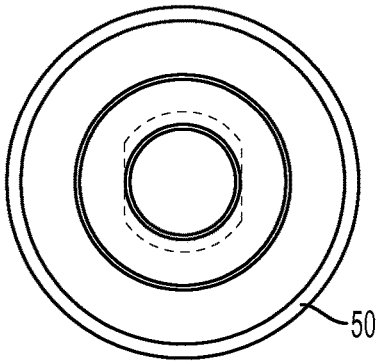
Figure 9D:
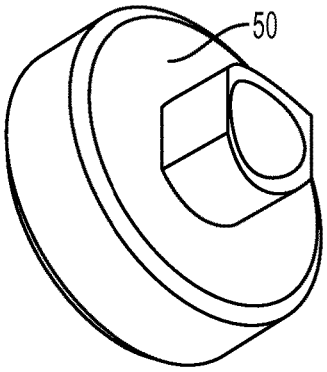

The nut driver 14 differs from a conventional socket in that it is modified in accordance with the present invention to be magnetic. In one embodiment, the nut driver body itself is magnetized. In a preferred embodiment, the nut driver 14 includes a fixedly attached magnet 18, such as a neodymium magnet. In such an embodiment, the magnet 18 is preferably seated at the base of a nut-receiving socket region 15, as best shown in FIG. 6. The exemplary nut driver 14 defines a pocket for receiving the magnet. The magnet 18 is positioned to couple magnetically with a nut, such as a chain bar nut 4, when the nut is positioned in the nut driver's socket region 15, to magnetically couple with the nut and support the hand tool 10 on the power tool 12, as shown in FIG. 3. For example, a 0.125"×0.75" neodymium magnet for a 19 mm, 12 point socket, and a 0.125"×0.50" neodymium magnet for the 13 mm socket, have been found suitable for this purpose.

Figure 4:
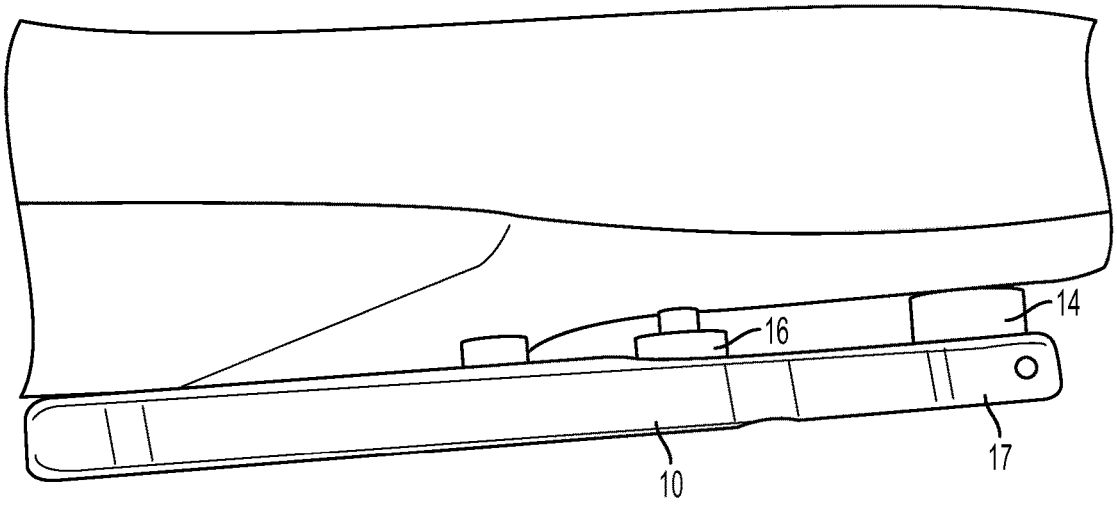
FIG. 4 is a top view of the hand tool of FIG. 1, showing the hand tool in the folded storage position.

In a preferred embodiment, a second magnet 16 is adhered or otherwise fixedly attached to the handle 12 in a position disposed intermediate of a length of the handle 12, to magnetically couple the hand tool 12 with the power tool's housing, to further assist in supporting the hand tool 10 on the power tool 2, as will be appreciated from FIGS. 1, 3 and 4. This allows a user to magnetically couple the hand tool 10 to the power tool 2, so that it will be secure and not fall off without the user applying some force to remove it. For example, a ⅛"×¾" neodymium magnet has been found suitable for the second magnet 16.

In a preferred embodiment, the nut driver 14 is pivotably-mounted to the handle 12, to pivot on a pivot pin 40 (see FIG. 12) extending through the nut driver 14 and a bifurcated support 17 of the tool's handle 10, as best shown in FIGS. 1 and 3. The pivotable mounting of the nut driver 14 to the handle 10 allows the nut driver 14 to pivot and be magnetically drawn to the chain bar nut 4, preventing it from slipping off during tightening or loosening of the nut, without applying enough force from the user to remove it. The pivoting nut driver 14 further allows the user to tighten or loosen the chain bar nuts at any angle within a 180-degree range of motion depending upon the leverage needed to tighten or loosen the chain bar nut, all while the nut driver 14 remains magnetically secured to the nut the user is working on. Further, it allows the handle 10 of the tool to be folded substantially flat against the body of the host power tool 2 for low-profile storage, as will be appreciated from FIGS. 1, 3 and 4.

The second body magnet 16 also provides a way to keep track of loose nuts by magnetically securing them to the tool, so that they will not be lost easily during disassembly.

Figure 5:
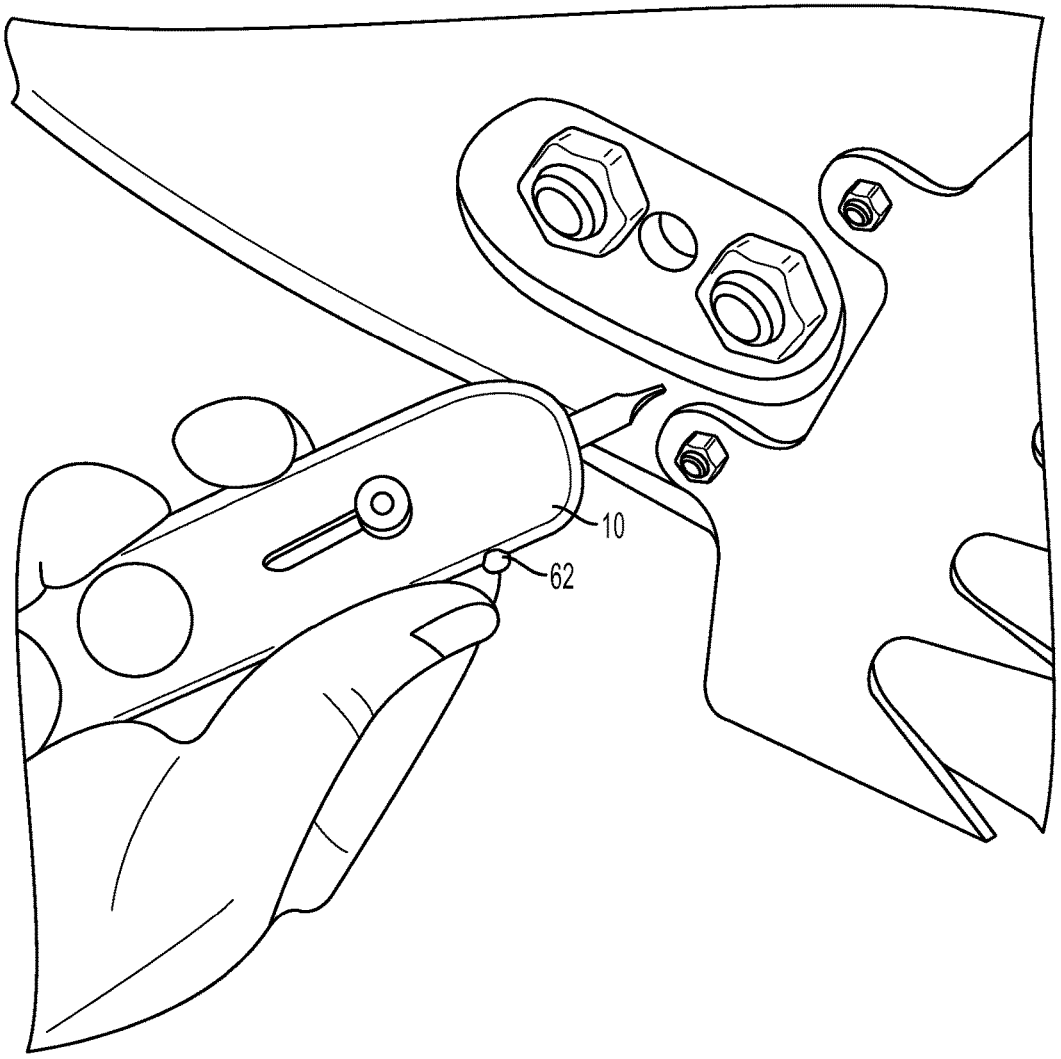
FIG. 5 is a back view of the hand tool of FIG. 1, showing a screwdriver tip extended in an operative position.

In this exemplary embodiment, the tool 10 further comprises a retractable screwdriver 14 retractably housed within the body of handle 12, as will be appreciated from FIGS. 2, 3 and 5. More specifically, the handle 10 defines internal channels for receiving and housing components of the retractable screwdriver mechanism, as shown in FIGS. 7A-7D.

A slotted shaft 20 including a straight-head screwdriver tip 22 is shown in FIGS. 8A-8D. The shaft 20 defines a longitudinally extending raceway 24, a transversely-extending opening 26 for receiving a set screw 40 (see FIGS. 10B and 11) for supporting a knurled button 50 (see FIGS. 9A-9D), and a spring-securing feature 28, which in this embodiment is an opening 28, at the end opposite the screwdriver tip 22.

Figure 10A:
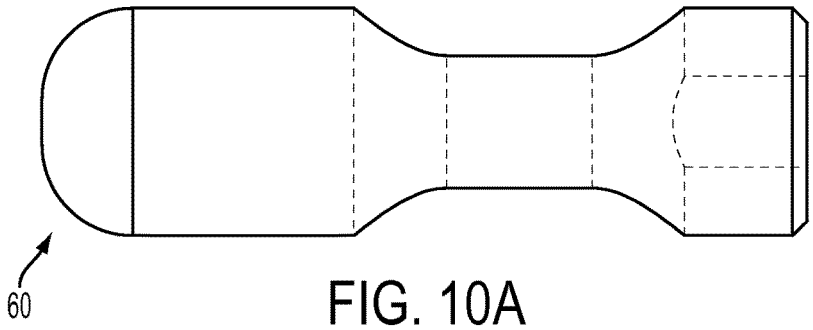
FIGS. 10A-10C shows top, side and perspective views, respectively, of the release plunger of the hand tool of FIG. 1.
Figure 10B:
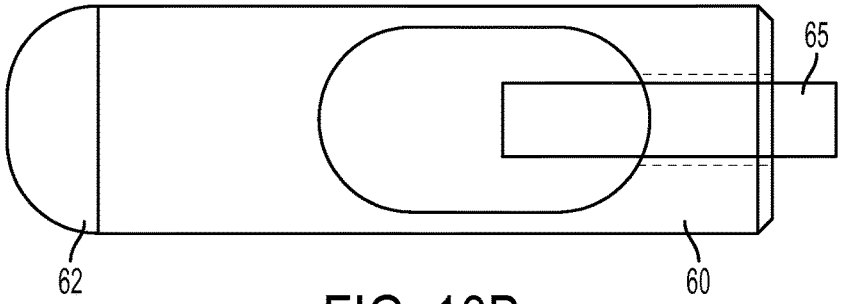
Figure 10C:
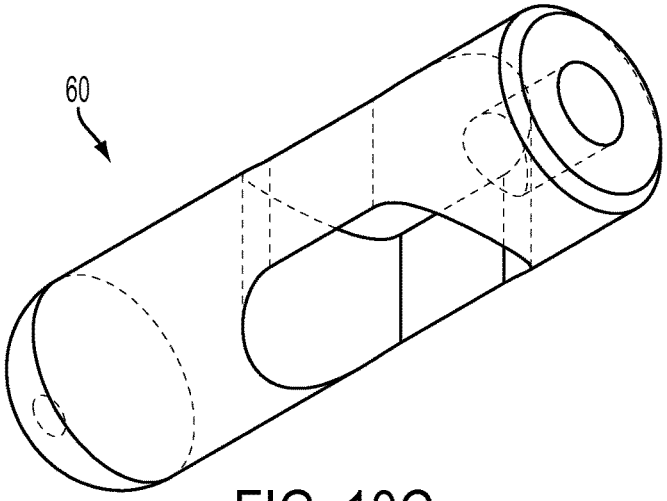
Figure 11:
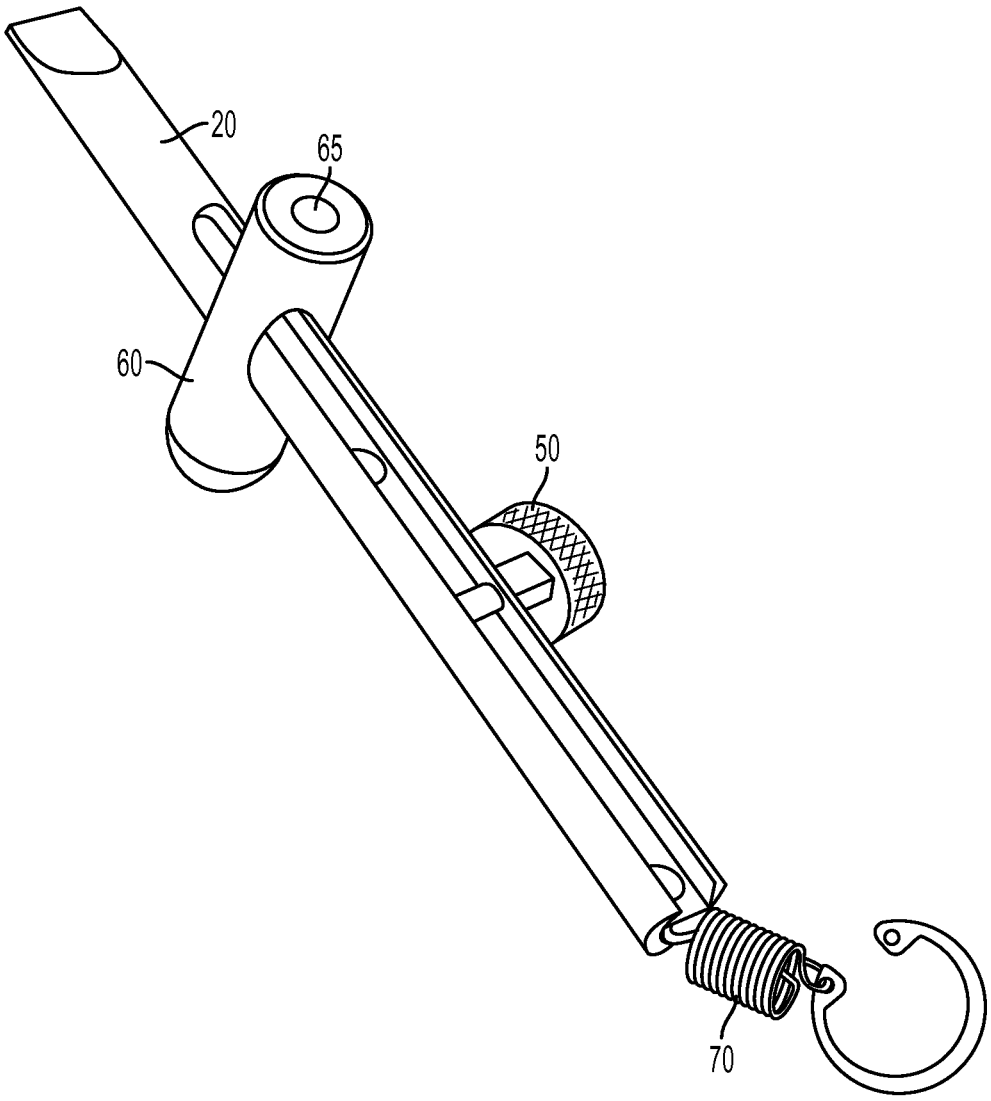
FIG. 11 shows the screwdriver shaft, knurled button and release plunger of FIGS. 8A-10C in an assembly including a spring mechanism.
Figure 12:
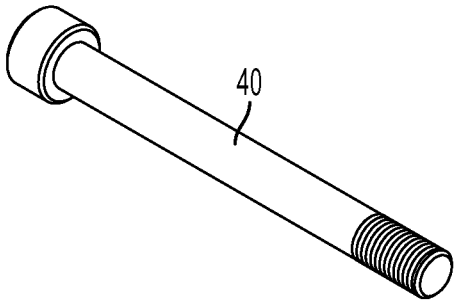
FIG. 12 is a perspective view of the pivot pin of the hand tool of FIG. 1.

The slotted shaft 20 further defines a transversely-extending through-opening 30. The through opening receives a pin 65 inserted during assembly through a release plunger 60, as shown in FIGS. 10B and 11. The release plunger is spring biased outwardly by a spring housed within the body. An assembly including these components is shown in FIG. 11.

After assembly of the hand tool, the screwdriver tip 22 can be extended for use by sliding the knurled button 50 (and thus the slotted shaft 20) toward the proximal end of the tool handle 12. This causes the pin 65 to ride in the raceway until it is in alignment with the through-opening 30, at which point a compressed spring housed in the handle causes the pin to move transversely to the axis of the slotted shaft, engage the opening 30, and lock the slotted shaft 20 in the extended position, as shown in FIG. 5. At this point, a retraction spring 70 (see FIG. 11) attached to the spring securing feature 28 and an internal portion of the housing 12 is stretched and storing energy. Further, the release plunger's tip 62 is positioned in alignment with or proud of the tool handle 12, as shown in FIGS. 2 and 5.

After using the screwdriver (e.g., to adjust a tensioning screw of a chainsaw housed between the chain bar nuts, as shown in FIG. 5), the screwdriver tip 22/slotted shaft 20 may be retracted into the body of the handle 12. This is achieved by depressing the tip 62 of the release plunger 60, as will be appreciated from FIG. 5. Such depressing causes the pin 65 to exit the through-hole 30, at which point the retraction spring 70 resiles to retract the slotted shaft while the pin 65 rides in the raceway 24 of the slotted shaft. The spring 70 may be secured to the body by way of a loop/pin and stud inserted through a transversely extending hole/port in the handle 12.

Figure 13:
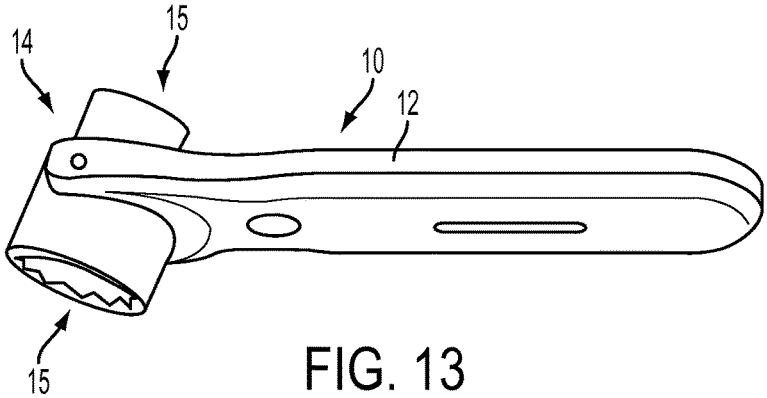
FIG. 13 is a perspective view of an alternative embodiment of the hand tool, including an alternative embodiment of a nut driver that includes multiple socket regions of different sizes.

FIG. 13 is a perspective view of an alternative embodiment of the hand tool 10. This embodiment is similar in many respects to that described above with reference to FIGS. 1-12. However, in this embodiment, the nut driver 14 that includes multiple socket regions of different sizes. For example, the hand tool accessory 10 may be provided with a larger (e.g., 19 mm) socket/nut driver, having a bored out portion on its base for receiving a smaller (e.g., 10 mm or 13 mm) housed and/or press fit into the base. It may be configured with similar openings on its base to receive the pivot pin 40, such that the same pivot pin 40 passes through both sockets/nut drivers in the same fashion. By pivoting the dual-driver body the larger sized socket side may be exposed to accept a larger chain bar nut/fastener to tighten or loosen with magnetic draw and the smaller sized socket side may be exposed to accept a smaller chain bar nut/fastener.

Figure 14:
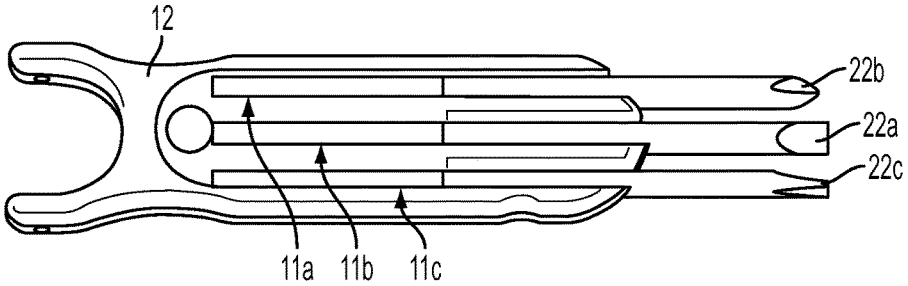
FIG. 14 is a side view of another alternative embodiment of the hand tool, including an alternative embodiment of the handle that includes multiple channels for housing multiple retractable screwdrivers.

FIG. 14 is a side view of another alternative embodiment of the hand tool accessory 10. This embodiment is similar in many respects to that described above with reference to FIGS. 1-12. However, in this embodiment, the handle 12 is configured to include multiple internal channels 11*a*, 11,*b*, 11*c*, for housing multiple retractable screwdrivers, each of which is configured similarly to that shown in FIGS. 8A-8D, but which collectively include different screwdriver tips, such as slotted or straight-tip 22*a*, a Phillips or other cruciform tip 22*b* and a Torx or other star tip 22*c*. It will be appreciated that the handle 12 is shown in FIG. 14 with a cutaway portion to reveal the internal channels 11*a*, 11*b*, 11*c* for illustrative clarity.

Figure 15:
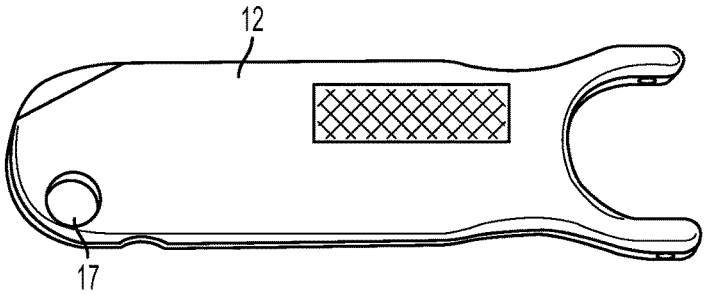
FIG. 15 is a side view of yet another alternative embodiment of the hand tool, including an alternative embodiment of the handle that includes a an opening through the body for fastening a carabiner or other hook or clip, and a shaped edge providing a rib for driving a slotted fastener.

FIG. 15 is a side view of yet another alternative embodiment of the hand tool accessory. This embodiment is similar in many respects to that described above with reference to FIGS. 1-12. However, in this embodiment, the handle 12 is configured to define an opening 17 extending through the handle body 12. The opening 17 provides a mounting point for fastening a carabiner or other hook or clip, rope, chain or other fastener. Further, this exemplary embodiment of the handle includes an edge portion that is shaped to provide a rib that is narrow, relative to the thickness of the body, and that is dimensioned to serve as a blade or driver for driving a slotted fastener, e.g., to open or close a slotted gas cap of a power tool. Further, in this exemplary embodiment, the handle includes a highly-reflective surface portion, such as reflective tape applied to the handle 12, to enhance visibility of the tool in brush, tall glass, leaves, etc., and thus to facilitate retrieval of a lost tool, particularly with a flashlight in low-ambient-light conditions.

Figure 16:
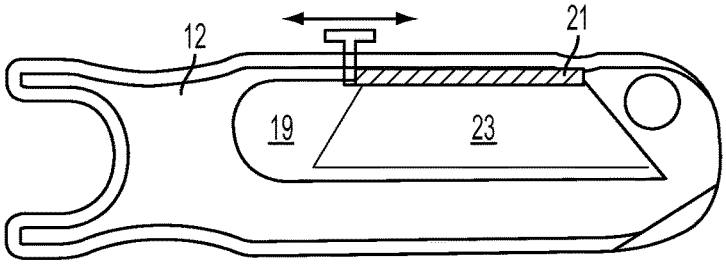
FIG. 16 is a side view of still another alternative embodiment of the hand tool, including an alternative embodiment of the handle that includes not only the features of the embodiment of FIG. 15, but also defines a raceway for receiving a retractable blade carriage for providing retractable utility knife functionality.

FIG. 16 is a side view of still another alternative embodiment of the hand tool accessory. This embodiment is similar in many respects to that described above with reference to FIGS. 1-12. However, in this embodiment, the handle 12 is configured to define a raceway 19, the handle being shown in FIG. 16 with a cutaway portion to show the raceway with illustrative clarity. The raceway structure, blade carriage/button 21 and blade 23 may all be of a conventional type of the type used in conventional utility knives. Accordingly, this embodiment of the hand tool accessory further provides retractable utility knife functionality.

Having thus described a few particular embodiments of the invention, various alterations, modifications, and improvements will readily occur to those skilled in the art. Such alterations, modifications, and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A hand tool for servicing a device comprising a nut fastener, the hand tool comprising:

a longitudinally extending handle body, said handle body defining a bifurcated support;

a pivot pin extending through said bifurcated support transversely to an axis of elongation of said handle body;

a nut driver supported on said pivot pin for pivotable motion between a first position, in which an axis of said nut driver extends in a direction of an axis of elongation of said handle body, and a second position, in which the axis of said nut driver extends transversely to the axis of elongation of said handle body, said nut driver defining a socket region dimensioned to receive a nut;

a first magnet supported in said nut driver in position to couple magnetically with the device's nut positioned within said socket region; and a second magnet supported on said handle body intermediate a length of said handle body to magnetically couple with said device when said first magnet is magnetically coupled with said nut and said nut driver is in said second position; and a slotted shaft supported in sliding relationship to said handle body, said slotted shaft having at one end a screwdriver tip, said slotted shaft being slidable between a retracted position, in which said screwdriver tip is housed within said handle body, and an operative position, in which said screwdriver tip is extended beyond said handle body and exposed for use, and said slotted shaft defines a longitudinally extending raceway, an opening for receiving a set screw extending transversely of said raceway, a spring-securing feature at an end opposite said screwdriver tip, wherein said slotted shaft further defines a transversely-extending through-opening, wherein said handle body supports a slidable release plunger supporting a pin positioned in said through-opening, said hand tool further comprising a retraction spring secured to said spring-securing feature to retract said slotted shaft when said pin exits said through-opening.

2. The hand tool of claim 1, wherein said first magnet is disposed at a base of said socket region.

3. The hand tool of claim 1, wherein said nut driver defines a plurality of sockets regions dimensioned to receive nuts of different sizes.

4. The hand tool of claim 3, wherein said nut driver comprises a first socket body press fit into a bore in a second socket body.

5. The hand tool of claim 1, wherein said screwdriver tip comprises one of a straight-head screwdriver tip, a cruciform-head screwdriver tip, and a star-head screwdriver tip.

6. The hand tool of claim 1, wherein said handle body defines an internal channel extending longitudinally of said handle body, and wherein said sliding shaft is supported in said internal channel.

7. The hand tool of claim 1, wherein said handle body defines a plurality of internal channels extending longitudinally of said handle body in parallel relationship to one another.

8. The hand tool of claim 7, further comprising a plurality of sliding shafts, each one of said plurality of sliding shafts being supported in sliding relationship in a respective one of said plurality of internal channels, each of said plurality of sliding shafts having its end a corresponding screwdriver tip of a plurality of screwdriver tips, each sliding shaft being slidable between a retracted position, in which a corresponding screwdriver tip is housed within said handle body, and an operative position, in which said corresponding screwdriver tip is extended beyond said handle body and exposed for use.

9. The hand tool of claim 8, wherein said screwdriver tips are of different respective configurations selected from a group consisting of a straight-head screwdriver tip, a cruciform-head screwdriver tip, and a star-head screwdriver tip.

10. The hand tool of claim 1, wherein said handle body defines an opening extending through said handle body.

11. The hand tool of claim 1, wherein said handle body has an edge portion shaped to provide a rib that is narrow relative to a thickness of said handle body.

12. The hand tool of claim 1, wherein said handle body comprises a highly-reflective surface.

13. The hand tool of claim 12, wherein said highly-reflective surface comprises reflective tape adhered to said handle body.

14. A hand tool comprising:

a longitudinally extending handle body;

a nut driver supported on said handle body for pivotable motion relative thereto, said nut driver defining a socket region dimensioned to receive a nut;

a magnet supported on said handle body intermediate a length of said handle body, wherein at least one of a size and a strength of said magnet is selected to ensure said handle remains securely coupled to a power tool during operation of said power tool; and a slotted shaft supported in sliding relationship to said handle body, said slotted shaft having at one end a screwdriver tip, said slotted shaft being slidable between a retracted position, in which said screwdriver tip is housed within said handle body, and an operative position, in which said screwdriver tip is extended beyond said handle body and exposed for use, and said slotted shaft defines a longitudinally extending raceway, an opening for receiving a set screw extending transversely of said raceway, a spring-securing feature at an end opposite said screwdriver tip, wherein said slotted shaft further defines a transversely-extending through-opening, wherein said handle body supports a slidable release plunger supporting a pin positioned in said through-opening, said hand tool further comprising a retraction spring secured to said spring-securing feature to retract said slotted shaft when said pin exits said through-opening.

15. A hand tool comprising:

a longitudinally extending handle body;

a nut driver supported on said handle body for pivotable motion relatively thereto, said nut driver defining a socket region dimensioned to receive a nut of an associated device, said nut driver being magnetized to couple magnetically with a nut positioned within said socket region;

a magnet supported on said handle body intermediate a length of said handle body to magnetically couple with a housing of said associated device when said nut driver is magnetically coupled with said nut: and a slotted shaft supported in sliding relationship to said handle body, said slotted shaft having at one end a screwdriver tip, said slotted shaft being slidable between a retracted position, in which said screwdriver tip is housed within said handle body, and an operative position, in which said screwdriver tip is extended beyond said handle body and exposed for use, and said slotted shaft defines a longitudinally extending raceway, an opening for receiving a set screw extending transversely of said raceway, a spring-securing feature at an end opposite said screwdriver tip, wherein said slotted shaft further defines a transversely-extending through-opening, wherein said handle body supports a slidable release plunger supporting a pin positioned in said through-opening, said hand tool further comprising a retraction spring secured to said spring-securing feature to retract said slotted shaft when said pin exits said through-opening.

16. The hand tool of claim 15, wherein said magnetic nut driver comprises a first magnet supported on said nut driver.

* * * * *